United States Patent [19]

Wyatt et al.

[11] Patent Number: 4,813,486

[45] Date of Patent: Mar. 21, 1989

[54] RETRACTABLE SLIP ASSEMBLY

[75] Inventors: Mark L. Wyatt; Andrew J. Tucker, both of Tulsa, Okla.

[73] Assignee: Arrow Oil Tools, Inc., Tulsa, Okla.

[21] Appl. No.: 100,303

[22] Filed: Sep. 23, 1987

[51] Int. Cl.[4] ..... E21B 23/00; E21B 33/129

[52] U.S. Cl. ..... 166/118; 166/120; 166/217

[58] Field of Search ..... 166/118, 120, 134, 140, 166/138, 217, 212

[56] References Cited

U.S. PATENT DOCUMENTS

| | | | |
|---|---|---|---|
| 2,404,692 | 7/1946 | Church | 166/134 X |
| 2,920,703 | 1/1960 | Rodgers | 166/217 X |
| 3,631,927 | 1/1972 | Young | 166/134 |

*Primary Examiner*—Stephen J. Novosad

*Attorney, Agent, or Firm*—Edgar A. Zarins; Malcolm L. Sutherland; Leon E. Redman

[57] ABSTRACT

A retractable slip assembly for downhole oil tools such as packers and anchors which permits retrieval of the tool with a minimum of force and without damaging the casing or tool. The slip assembly includes a plurality of slip elements adapted to engage a setting cone which moves the slips outwardly into engagement with the casing wall. The individual slip elements travel within slip windows formed in an outer sleeve. In addition to guiding the slips, the slip windows facilitate retraction of the slip elements. In order to reduce the force necessary to release the slip assemblies, the engaging edges of the slip elements and the slip windows are provided with a cooperating angle corresponding to the slope of the setting cone and slip underside. The reduced force necessary to retract the slips allows the use of upper and lower slip assemblies in conjunction with a packer assembly.

20 Claims, 3 Drawing Sheets

RETRACTABLE SLIP ASSEMBLY

BACKGROUND OF THE INVENTION

I. Field of the Invention

This invention relates to downhole oil tools utilized to seal or pack-off a casing segment and, in particular, to a downhole tool run on a well string within the casing, the tool including a plurality of retractable slips adapted to permit removal of the tool with a minimum of force and without damaging the casing wall.

II. Description of the Prior Art

Packers and setting tools are widely used in drilling operations to isolate particular segments of the casing or to provide an anchor for other tools. Such devices normally employ one or more sets of slips adapted to engage and "grasp" the casing wall in order to provide solid engagement. Packers normally also include at least one packing element in order to seal off the casing and prevent fluid flow above or below the packer. A tremendous amount of force is applied, either hydraulically or mechanically, to the tool in order to properly set the slips and packer elements. Attempts to overcome this setting force to release the device often times results in damage to the casing wall or the tool itself.

Past known slip assemblies generally comprise a plurality of slip elements circumferentially spaced on the outer periphery of the tool. The slip elements include outer serrations adapted to engage the casing wall. A longitudinally movable slip cone disposed beneath the slip assembly is utilized to wedge the slip elements outwardly against the casing wall. Interacting sloped surfaces on the cone and the leading edge of the slip elements gradually moves the slips towards the casing wall. In order to prevent lateral and longitudinal movement of the slips, each element is disposed within a slip window formed as part of an outer sleeve. The slip window and the edges of the slips are provided with square surfaces to ensure that the elements travel radially outward. However, because of the square abutment of the slip window with the slip element when an attempt is made to retract the slips, an unacceptable amount of force is required. Accordingly, in many packers and setting tools only one set of slips, below the packing elements, is normally utilized to initially anchor the tool.

SUMMARY OF THE PRESENT INVENTION

The present invention overcomes the disadvantages of the prior known slip systems by providing means for retracting the slip elements with a minimum of force and without damaging the tool or casing.

The slip assembly of the present invention generally comprises a plurality of circumferentially spaced slip elements disposed within slip windows formed in a longitudinally movable outer sleeve. The slip elements are mounted to the inner mandrel of the tool and are adapted to engage a setting cone located beneath the movable sleeve. The cone and the slip elements have engaging sloped surfaces which cooperate to force the slip outwardly as the cone is moved longitudinally relative to the slip assembly. The outer edge of the slip elements is provided with serrations or teeth to firmly engage the casing wall.

In the packer tool of the present invention, a pair of slip assemblies are provided in conjunction with the packing elements. One slip assembly is provided downhole of the packer while the other is located uphole of the packing elements. In setting the tool, the downhole slips will be set first. During release, the upper slips are designed to retract prior to the lower slips thereby reducing the amount of force necessary to release the tool. In order to retract the slip elements, the outer sleeve of the upper slip assembly is pulled upwardly such that the lower edge of the slip window engages the lower edge of the element thereby moving the slip down the sloped surface of the setting cone. The edge of the window and the edge of the slip are provided with identical slope angles which correspond to the slope angle of the slip teeth and the slope angle of the setting cone. By providing identical, non-square angles, the force required to dislodge the slips without causing damage is significantly reduced. Because less force is required to dislodge and retract the slips, two slip assemblies on either side of the packer may be provided.

Other objects, features, and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
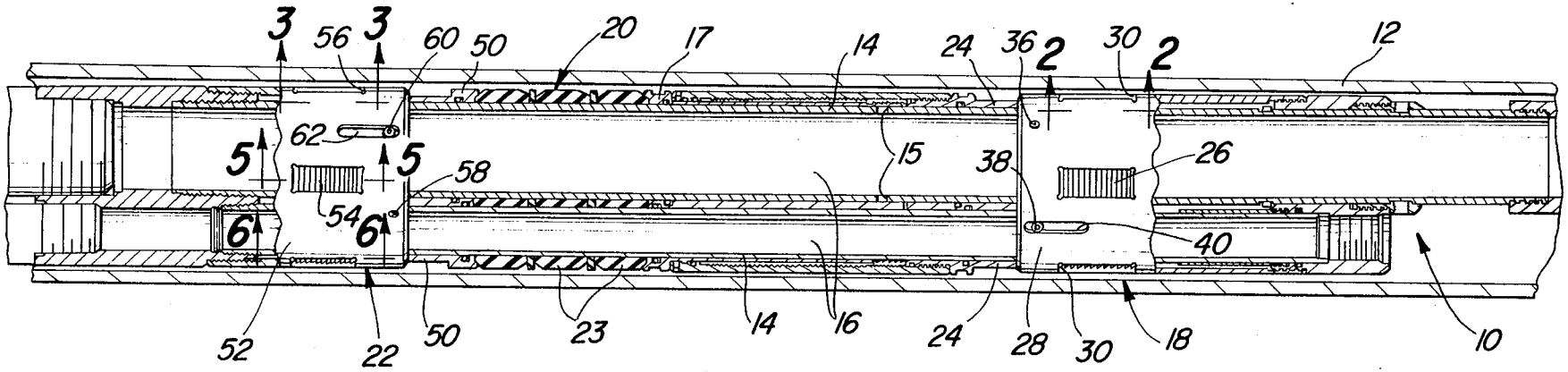
FIG. 1 is a cross-sectional perspective of an oil tool embodying the slip assembly of the present invention.

Referring first to FIG. 1, there is shown an oil tool 10 embodying the slip assembly of the present invention and adapted to be run and set within a well casing 12. Although the drawings show a particular tool it is to be understood that the present invention can be utilized with any type of oil tool designed to be set within a bore hole. Such devices generally include one or more slip assemblies to anchor the tool and a packing assembly which sealingly engages the casing wall 12 to seal or isolate a section of the casing. However, such oil tools 10 generally include an inner mandrel 14 having one or more longitudinal passageways 16 therethrough for the transfer of drilling fluids and the like. In this manner, the tool 10 can seal off a section of the casing 12 while permitting the controlled flow of fluids therethrough.

In a preferred embodiment of the present invention illustrated in FIG. 1, the oil tool 10 comprises a lower slip assembly 18, a packer assembly 20, and an upper slip assembly 22 all concentrically mounted to the inner mandrel 14 of the tool 10. The packer assembly 20 is disposed intermediate the lower and upper slip assemblies 18 and 22 and includes at least one packer element 23 made of an elastomer material to seal against the casing wall 12 once the tool 10 is set. The actual configuration of the packer assembly 20 may be varied according to the customer's specifications and will be described in greater detail hereinafter.

Figure 2:
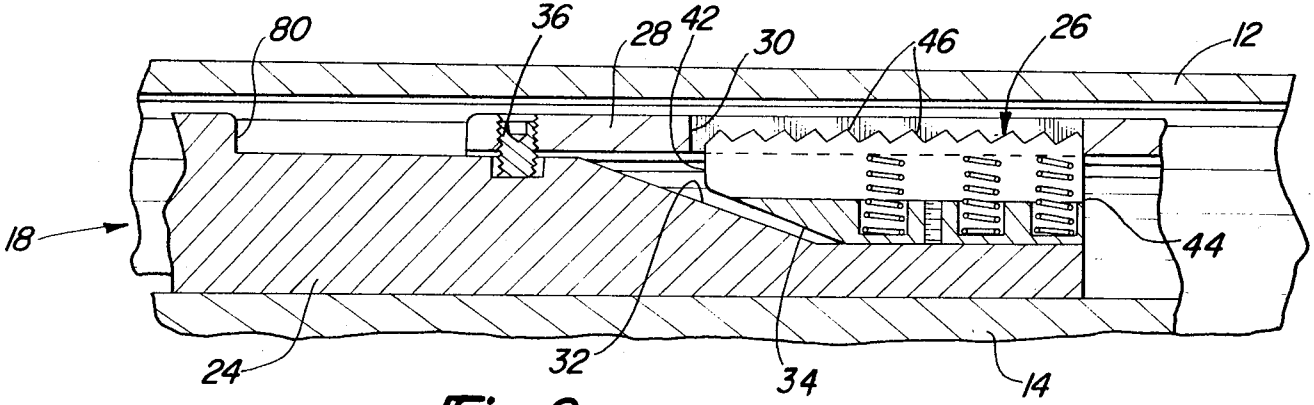
FIG. 2 is a cross-sectional perspective of one of the slip assemblies taken along line 2—2 of FIG. 1.

Referring now to FIGS. 1 and 2, the lower slip assembly 18 may be considered a conventional slip assembly adapted to engage the casing wall 12. In practice, the lower slip assembly 18 generally requires less force to release following retraction of the upper slip assembly 22 and the packer 20 as will be subsequently described. The lower slip assembly 18 of the present invention generally comprises a setting cone 24, a plurality of slip elements 26, and an outer sleeve 28 having a corresponding number of slip windows 30 adapted to receive the individual slip elements 26. The setting cone 24 has a sloped surface 32 adapted to engage a matingly sloped underside surface 34 of the slip elements 26 in order to move the slip elements 26 radially outwardly into engagement with the casing wall 12. The setting cone 24 is initially connected to the outer sleeve 28 by a series of shear screws 36 such that the sleeve 28 and cone 24 travel in the hole together. The setting cone 24 and sleeve 28 are also slidably connected by torque screws 38 received within longitudinal slots 40 which prevent the components of the setting assembly from separating while allowing limited relative longitudinal movement.

The slip elements 26 of the lower slip assembly 18 have a substantially square configuration with both the leading edge 42 and the lower edge 44 of the elements 26 cooperatively engaging the substantially rectangular cross-sectional configuration of the slip windows 30. In this manner, the slip elements 26 will be guided outwardly through the windows 30 as the setting cone 24 passes beneath the elements 26 until the slip teeth 46 engage the casing wall 12. As the setting cone 24 moves relative to the outer sleeve 28 and the slip elements 26, the sloped surfaces 32 and 34 cooperate to move the slip elements 26 outwardly. When it becomes necessary to retract the slip elements 26, the setting cone 24 is longitudinally retracted thereby causing the edge of the slip window 30 to engage the slip element 26 to move the element 26 down the sloped surface 32 of the setting cone 24 as the cone 24 moves longitudinally from beneath the slip elements 26. Because the lower slip assembly 18 is released last, the force required for retraction is considerably less than the force necessary to release the upper slips 22. Moreover, the force necessary for retraction of the lower slip elements 26 must only overcome the frictional force between the setting cone 24 and the individual slip elements 26. For this reason, many past known oil tools include lower slips which can be retracted.

Referring now generally to FIGS. 3 through 6, there are shown multiple views of the upper slip assembly 22 which employs a unique configuration to facilitate release of the upper slip assembly 22 with a minimum of force. Similar to the lower slip assembly 18, the upper assembly 22 generally comprises a setting cone 50, a plurality of slip elements 52, and an outer sleeve 54 having a corresponding number of slip windows 56 adapted to receive the individual slip elements 52. The upper slip assembly 22 also includes a series of screws 58 adapted to shear at a predetermined force and a torque screw 60 slidably disposed within a slot 62 in order to prevent separation of the individual components. Slip teeth 64 are formed on the outer surface of the slip elements 52 to facilitate firm engagement with the casing wall 12.

Figure 4:
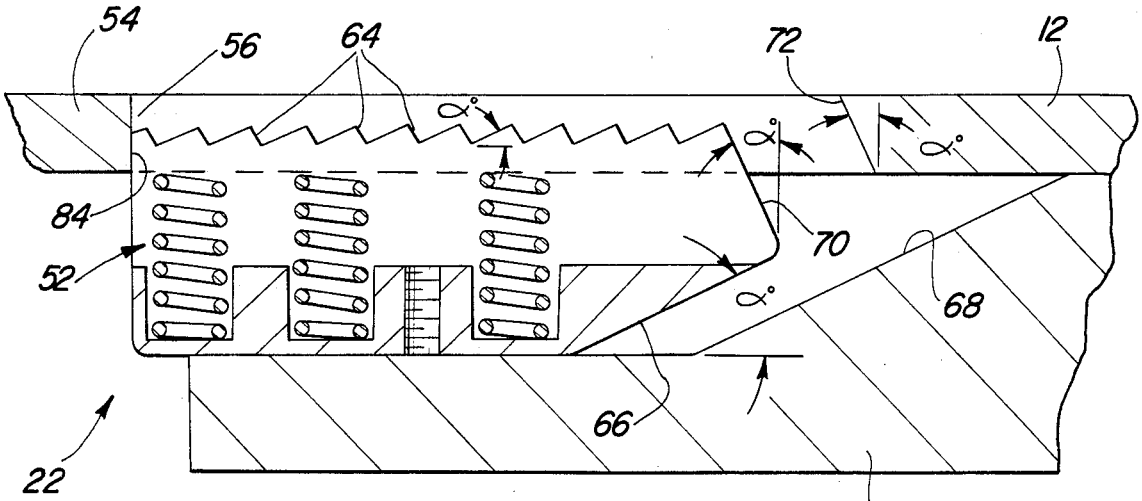
FIG. 4 is an enlarged cross-sectional perspective of the slip assembly embodying the present invention.

The slip elements 52 include a sloped underside surface 66 which cooperates with the slope surface 68 of the cone 50 to gradually move the slip elements 52 outwardly into engagement with the casing 12. The slip elements 52 further include an engagement edge 70 formed at a predetermined angle $\alpha$. Similarly, a first edge 72 of the slip window 56 is sloped at an angle $\alpha$ in order to provide mating contact between the first edge 72 and the engagement edge 70 of the slip elements 52. The angle $\alpha$ of the engagement edge 70 and edge 72 of the slip window 56 is substantially equal to the slope angle of the cone surface 68 and the mating underside surface 66 of the slip elements 52. Furthermore, the slip teeth 64 are similarly formed at the identical angle $\alpha$. In this manner, the slip teeth 64, the engagement edge 70, the edge 72 of the slip window 56, the underside surface 66 of the slip element 52, and the sloped surface 68 of the setting cone 50 are all formed at the identical angle $\alpha$ as best shown in FIG. 4. By forming all of these components at an identical angle $\alpha$, the force required to retract the slip elements 52 without severely damaging the casing wall 12 or the tool 10 is significantly reduced. In one embodiment of the present invention, the angle $\alpha$ must be between 10° and 45° with a preferred angle of approximately 25°.

Operation of the present invention permits conventional setting of the oil tool 10 within the casing 12, through either mechanical or hydraulic means, and release of the tool 10 for retrieval from the casing 12 without damaging the casing wall 12 or the tool itself. Once the tool 10 is run to the desired depth within the casing 12, force is transmitted through the upper slip assembly 22 and the packer assembly 20 to move the setting cone 24 relative to the outer sleeve 28. As hydraulic pressure is supplied through the inner mandrel 14 and through the ports 15, the lower setting cone 24 and the setting mandrel 17 will be forced longitudinally in opposite directions from the ports 15. The setting mandrel 17, through the packer 20, will cause the upper setting cone 50 to move upwardly. When a predetermined force is applied, the screws 36 will shear freeing the cone 24 to travel beneath the sleeve 28. As the setting cone 24 moves relative to the sleeve 28 and the slip elements 26, the sloped surface 32 of the cone 24 will cooperate with the surface 34 of the slip elements 26 to wedge the elements outwardly through the slip window 30 and into engagement with the casing 12. The setting cone 24 will travel relative to the sleeve 28 and slip elements 26 until the slip teeth fully engage the casing wall 12.

As the lower setting cone 24 and the setting mandrel 17 separate, a locking nut assembly 82 will ratchet together to prevent inadvertent decoupling of the setting mechanisms.

Figure 3:
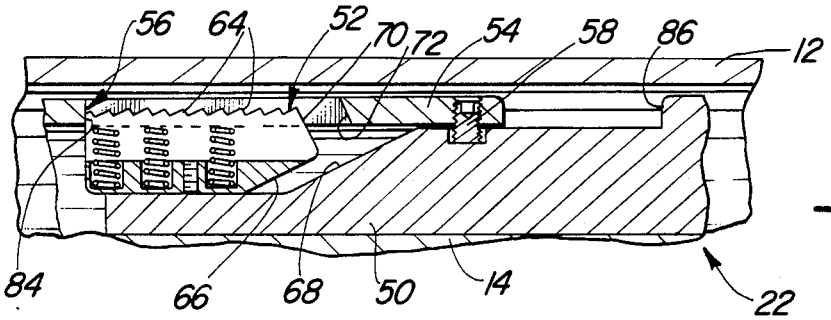
FIG. 3 is a cross-sectional perspective of the other slip assembly in its unset position taken along line 3—3 of FIG. 1.
Figure 3A:
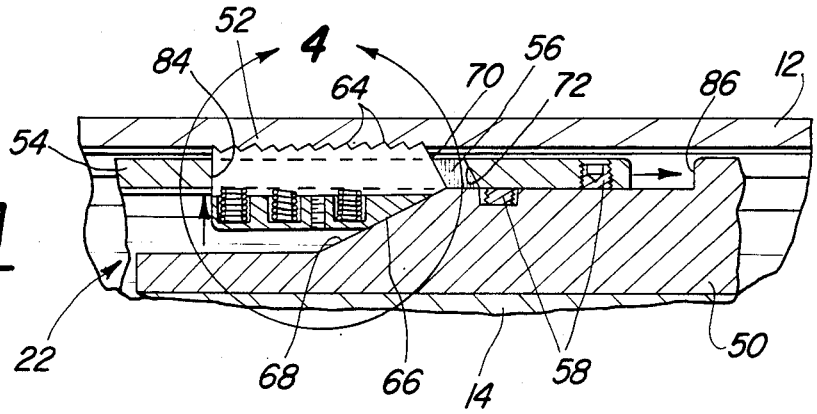
FIG. 3A is a cross-sectional perspective of the slip assembly of FIG. 3 in a set position.

At approximately the same time that the lower slip assembly 18 begins to set, continued pressure will cause screws 58 to shear thereby permitting movement of the upper setting cone 50 relative to the outer sleeve 54. As the upper setting cone 50 is moved longitudinally upward, the trailing edge 84 of the slip windows 56 will push the slip elements 52 (FIG. 3) along the sloped surface 68 of the setting cone 50 thereby forcing the slip elements 52 radially outward into engagement with the casing 12 (Fig. 3A). As force is applied, the slip teeth 64 will penetrate the casing wall 12. The setting cone 50 will continue to travel relative to the outer sleeve 54 until further travel is prevented by fully engagement of the slips with the casing wall 12. The oil tool 10 is now fully set and production operations may be continued.

With both slip assemblies set, the upper setting cone 50 is prevented from further movement and the setting mandrel 17 will move against the packer 20 to compress the individual packing elements 23 into sealing engagement with the casing wall 12.

Figure 5:
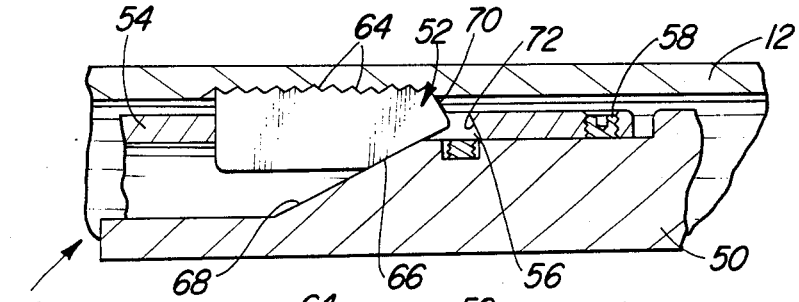
FIG. 5 is a cross-sectional perspective of a first slip element in a fully set position prior to retraction of the slip assembly taken along line 5—5 in FIG. 1.
Figure 6:
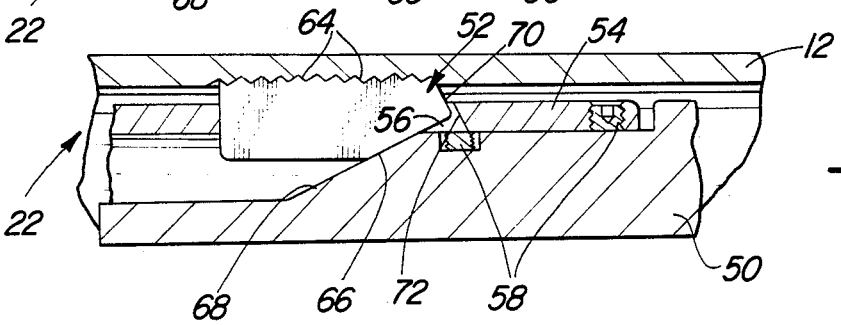
FIG. 6 is a cross-sectional perspective of a second slip element of the slip assembly in a fully set position prior to retraction taken along line 6—6 on FIG. 1.
Figure 5A:
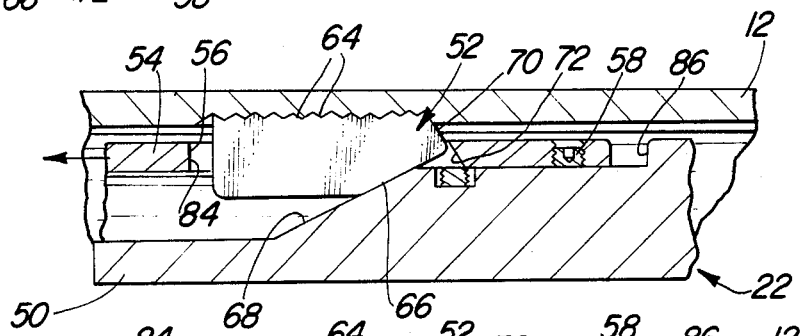
FIG. 5A is a cross-sectional perspective of the first slip element as retraction begins.

Referring now to FIGS. 5 and 6, when it becomes necessary to retrieve the tool 10 the outer sleeve 54 is utilized to retract the slip elements 52 away from the casing wall 12. However, in order to minimize the force required to retract the slip assembly 22, the slip windows 56 of the upper slip assembly 22 have different lengths thereby ensuring that only one slip element 52 will be acted on at a time. Two examples of this principle are shown in the drawing series of FIG. 5 and FIG. 6. The slip window 56 of FIG. 5 is longer than the slip window 56 of FIG. 6. Since all of the slip windows 56 are formed in the upper sleeve 54, they will all travel the same speed and distance. However, because the first edge 72 of the windows 56 will engage the slip elements 52 at different positions, only one slip element will be acted upon at a time.

Figure 6A:
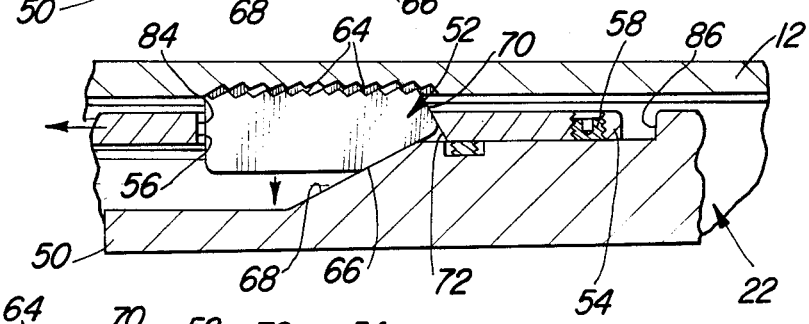
FIG. 6A is a cross-sectional perspective of the second slip element as retraction begins.
Figure 5B:
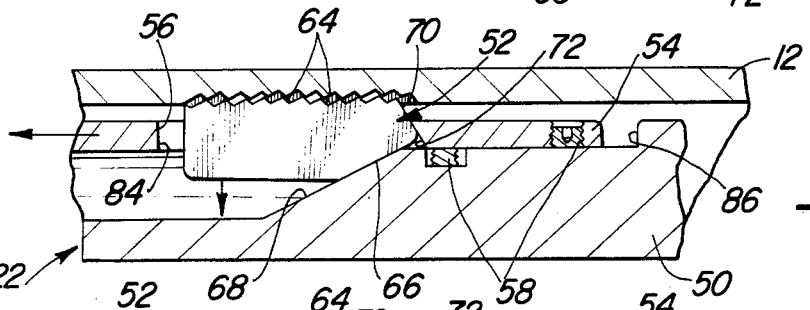
FIG. 5B is a cross-sectional perspective of the first slip element in continued retraction.
Figure 6B:
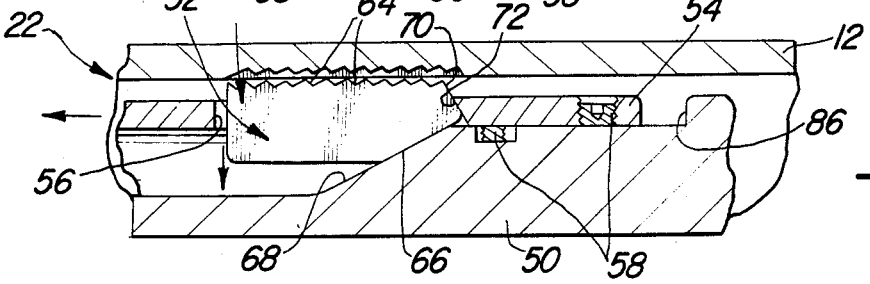
FIG. 6B is a cross-sectional perspective of the second slip element in continued retraction.

As the slip elements 52 and the setting cone 50 of the upper slip assembly 22 remain stationary, the outer sleeve 54 is retracted upwardly. When the first edge 72 of a particular slip window 56 engages the engagement edge 70 of the corresponding slip element 52, the slip 52 will be forced to travel down the sloped surface 68 of the setting cone. With the first slip element 52 dislodged from the casing wall 12 (FIG. 6A), continued movement of the sleeve 54 will cause the first edge 72 of the next shortest slip window 56 to engage the edge 70 of the corresponding slip element 52 and dislodge the slip 52 from the casing wall 12. This continues until all of the slip elements 52 are individually dislodged from the casing wall 12. With continued retraction of the sleeve 54, the first slip element 52 will be fully retracted from the casing (FIG. 6B) while one or more of the remaining slips 52 will still be in contact with the casing (Fig. 5B). Thus, by varying the length of the slip windows 56 the force required to retract the slip elements 52 can be controlled and reduced. In essence, the required force is spread out over all of the slip elements 52 of the upper slip assembly 22.

As the upper slip assembly 22 releases, the packer assembly 20 will release disengaging the packer members 23 from the casing wall. With the majority of the pressure released, continued retraction will cause the setting cone 24 of the lower slip assembly 18 to retract thereby releasing the slip elements 26 from engagement with the casing 12. The oil tool 10 can now be retrieved from the well casing fully intact and with minimum deformation of the casing wall 12.

The foregoing detailed description has been given for clearness of understanding only and no unnecessary limitations should be understood therefrom as some modifications will be obvious to those skilled in the art without departing from the scope and spirit of the appended claims.

We claim:

1. A releasable slip assembly for an oil tool adapted to be set within a well casing, aid slip assembly mounted to an inner mandrel of the oil tool, said slip assembly comprising:

at least one slip element movable radially outward relative to the mandrel of the oil tool, said slip element including a plurality of slip teeth and an engagement edge;

an outer sleeve slidably mounted to the mandrel, said sleeve having at least one slip window adapted to receive said slip element, said slip window having a first edge adapted to cooperate with said engagement edge of said slip element; and a setting cone mounted to the mandrel beneath said outer sleeve, said cone having a sloped surface adapted to engage said at least one slip element to move said element radially outwardly into engagement with said well casing;

wherein said engagement edge of said slip element and said first edge of said slip window have corresponding angular slopes such that upon longitudinal movement of said outer sleeve, said first edge engages said engagement edge of said slip element thereby retracting said slip element radially inwardly;

said slip teeth of said slip elements, said engagement edge of said slip elements, said first edge of said slip windows, and said sloped surface of said setting cone having substantially identical angular slopes.

2. The slip assembly as defined in claim 1 wherein said sloped surface of said setting cone has an angular slope substantially equal to said angular slopes of said first edge of said slip window and said engagement edge of said slip element whereby as said outer sleeve is longitudinally retracted said first edge of said slip window cooperates with said engagement edge to move said slip element down said sloped surface of said setting cone.

3. The slip assembly as defined in claim 2 wherein said slip windows of said sleeve are of different lengths such that said first edge of said slip window engages said corresponding slip element at different points during retraction of the outer sleeve thereby retracting said slip elements of said assembly individually.

4. The slip assembly as defined in claim 1 wherein said angular slope of said engagement edge and said first edge of said slip window is between 10° and 45°.

5. The slip assembly as defined in claim 1 wherein said angular slope of said engagement edge and said first edge of said slip window is 25°.

6. A releasable slip assembly for an oil tool adapted to be set within a well casing, said slip assembly mounted to an inner mandrel of the oil tool, said slip assembly comprising:

a plurality of slip elements movable radially outward relative to the mandrel of the oil tool into engagement with the casing wall, said slip elements including a plurality of slip teeth adapted to engage said casing wall, said slip teeth being formed at a slope angle $\alpha$;

an outer sleeve slidably mounted to the mandrel, said sleeve having a plurality of circumferentially spaced slip windows, each of said slip windows adapted to receive said slip element, said slip windows having a first edge with slope angle $\alpha$ adapted to cooperate with said engagement edge of said slip element to move said slip element out of engagement with the casing wall; and a setting cone mounted to the mandrel, said cone having a sloped surface adapted to engage an underside surface of said slip elements to move said elements radially outwardly into engagement with said well casing, said sloped surface of said setting cone and said underside surface of said slip elements having a cooperating slope angle $\alpha$;

said slope angle $\alpha$ of said slip teeth, said engagement edge, said first edge, said underside surface, and said cone surface being substantially identical;

wherein said sloped surface of said setting cone slidably engages said underside surface of said slip elements to move said elements radially outwardly through said slip windows into engagement with the casing wall thereby setting said slip assembly; and wherein said first edge of said slip windows engages said engagement edge of said slip elements upon longitudinal movement of said outer sleeve to move said slip elements down said sloped surface of said setting cone thereby releasing said slip assembly.

7. The slip assembly as defined in claim 6 wherein said slip windows of said sleeve are of different lengths such that said first edge of said slip windows engage said corresponding slip elements at different positions of retraction of said outer sleeve thereby retracting said slip elements of said assembly individually.

8. The slip assembly as defined in claim 6 wherein said slope angle $\alpha$ is between 10° and 45°.

9. The slip assembly as defined in claim 6 wherein said slope angle $\alpha$ is 25°.

10. The slip assembly as defined in claim 6 wherein said oil tool includes a packer assembly longitudinally spaced from said slip assembly.

11. The slip assembly as defined in claim 10 wherein said oil tool comprises a pair of said slip assemblies disposed on opposite sides of said packer assembly.

12. An oil tool adapted to be run and set within a well casing, said oil tool comprising:

an inner mandrel;

a packer assembly mounted to said mandrel, said packer assembly including at least one deformable packing element adapted to sealingly engage said casing wall;

an upper slip assembly mounted to said inner mandrel longitudinally above said packer assembly and adapted to releasably engage said casing wall; and a lower slip assembly mounted to said inner mandrel longitudinally below said packer assembly and adapted to releasably engage said casing wall;

said slip assemblies including a plurality of slip elements movable radially outward relative to said mandrel into engagement with the casing wall, said slip elements having a plurality of slip teeth adapted to engage said casing wall, and outer sleeve slidably mounted to the mandrel, said sleeve having a plurality of circumferentially spaced slip windows, each of said slip windows adapted to receive a slip element, and a setting cone mounted to the mandrel, said cone having a sloped surface adapted to engage an underside surface of said slip elements to move said elements radially outwardly into engagement with said well casing;

said slip windows of said upper slip assembly sleeve having different lengths and a first edge adapted to cooperate with an engagement edge of said slip elements, said first edge of said slip windows engaging said engagement edge of said corresponding slip elements at different positions of retraction of said outer sleeve upon longitudinal movement of said outer sleeve thereby moving said slip elements out of engagement with the casing wall individually to release said upper slip assembly.

13. The oil tool as defined in claim 12 wherein said engagement edge of said slip elements of said upper slip assembly is formed at an angle $\alpha$.

14. The oil tool as defined in claim 13 wherein said first edge of said slip windows is formed at a mating angle $\alpha$ to engage and cooperate with said engagement edge of said slip elements.

15. The oil tool as defined in claim 14 wherein said angle $\alpha$ is between 10° and 45°, the slope angle of said slip teeth, said engagement edge, said underside surface, said first edge of said slip window, and said cone surface being substantially identical for said upper slip assembly.

16. The oil tool as defined in claim 15 wherein said angle $\alpha$ is 25° to minimize the force necessary to release the oil tool from the casing while ensuring setting of the oil tool within the well casing.

17. A releasable slip assembly for an oil tool adapted to be set within a well casing, said slip assembly mounted to an inner mandrel of the oil tool, said slip assembly comprising:

at least one slip element movable radially outward relative to the mandrel of the oil tool, said slip element including a plurality of slip teeth and an engagement edge;

an outer sleeve slidably mounted to the mandrel, said sleeve having at least one slip window adapted to receive said slip element, said slip window having a first edge adapted to cooperate with said engagement edge of said slip element; and a setting cone mounted to the mandrel beneath said outer sleeve, said cone having a sloped surface adapted to engage said at least one slip element to move said element radially outwardly into engagement with said well casing;

said engagement edge of said slip element and said first edge of said slip window having corresponding angular slopes such that upon longitudinal movement of said outer sleeve said first edge engages said engagement edge of said slip element thereby retracting said slip element radially inwardly; and said slip windows of said sleeve are of different lengths such that said first edge of said slip window engages said corresponding slip element at different points during retraction of the outer sleeve thereby retracting said slip elements of said assembly individually.

18. An oil tool adapted to be run and set within a well casing and including an inner mandrel, said oil tool comprising;

a packer assembly mounted to said mandrel, said packer assembly including at least one deformable packing element adapted to sealingly engage said casing wall;

an upper slip assembly mounted to said inner mandrel longitudinally above said packer assembly and adapted to releasably engage said casing wall; and a lower slip assembly mounted to said inner mandrel longitudinally below said packer assembly and adapted to releasably engage said casing wall;

said upper slip assembly and said lower slip assembly includes;

a plurality of slip elements movable radially outward relative to said mandrel into engagement with the casing wall, said slip elements including a plurality of slip teeth adapted to engage said casing wall;

an outer sleeve slidably mounted to the mandrel, said sleeve having a plurality of circumferentially spaced slip windows, each of said slip windows adapted to receive a slip element; and a setting cone mounted to the mandrel, said cone having a sloped surface adapted to engage an underside surface of said slip elements to move said elements radially outwardly into engagement with said well casing;

said slip elements of said upper slip assembly includes an engagement edge formed at an angle $\alpha$ and said slip windows of said upper slip assembly includes a first edge formed at a mating angle $\alpha$ adapted to engage and cooperate with said engagement edge to move said slip elements out of engagement with the casing wall upon longitudinal movement of said outer sleeve thereby releasing said slip assembly, said slip windows of said upper slip assembly having different lengths such that said first edge of said slip windows engage said corresponding slip elements at different positions of retraction of said outer sleeve thereby retracting said slip elements of said upper slip assembly individually.

19. The oil tool as defined in claim 18 wherein said angle $\alpha$ is between 10° and 45°, the slope angle of said slip teeth, said engagement edge, said underside surface, said first edge of said slip window, and said cone surface being substantially identical for said upper slip assembly.

20. The oil tool as defined in claim 19 wherein said angle $\alpha$ is 25°.

* * * * *